US006609491B2

(12) United States Patent
Itoh et al.

(10) Patent No.: US 6,609,491 B2
(45) Date of Patent: Aug. 26, 2003

(54) MULTI-CYLINDER ENGINE AND ENGINE AUXILIARY PARTS MOUNTING CONSTRUCTION

(75) Inventors: Kenji Itoh, Saitama (JP); Manabu Komura, Saitama (JP); Masayoshi Mori, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/960,726

(22) Filed: Sep. 24, 2001

(65) Prior Publication Data

US 2002/0035980 A1 Mar. 28, 2002

(30) Foreign Application Priority Data

Sep. 26, 2000 (JP) ..... 2000-291434
Oct. 5, 2000 (JP) ..... 2000-306242
Oct. 5, 2000 (JP) ..... 2000-306246

(51) Int. Cl.[7] ..... F02B 77/00
(52) U.S. Cl. ..... 123/195 A; 123/184.42
(58) Field of Search ..... 123/195 A, 179.25, 123/184.38, 184.39, 184.41, 184.42, 184.43, 184.45, 195 R, 195 E, 198 R, 198 C, 195 AC, 195 C, 195 H

(56) References Cited

U.S. PATENT DOCUMENTS 4,886,020 A 12/1989 Bitter et al. ..... 123/52
5,040,493 A * 8/1991 Gajewski et al. ..... 123/41.31
5,099,945 A * 3/1992 Okui et al. ..... 180/297
5,197,427 A * 3/1993 Masuda et al. ..... 123/198 R
5,203,293 A * 4/1993 Shintani et al. ..... 123/195 A
5,259,356 A * 11/1993 Karlsson et al. ..... 123/541
5,291,864 A * 3/1994 Suga et al. ..... 123/198 R
5,357,931 A * 10/1994 Semence ..... 123/456
5,636,605 A * 6/1997 Nomizo et al. ..... 123/184.61
5,642,697 A * 7/1997 Jahrens et al. ..... 123/184.21
5,893,783 A * 4/1999 Hiraoka et al. ..... 440/88
5,908,366 A * 6/1999 Weismann et al. ..... 475/202
5,915,494 A * 6/1999 Matsumura et al. ..... 180/232
5,950,586 A * 9/1999 Ropertz ..... 123/184.42
6,041,748 A * 3/2000 Mueller et al. ..... 123/184.21
6,101,995 A * 8/2000 Itoh et al. ..... 123/195 A
6,273,047 B1 * 8/2001 Yoshikawa et al. .... 123/184.42
6,324,744 B1 * 12/2001 Banks et al. ..... 29/525.13
6,346,018 B1 * 2/2002 Watanabe ..... 440/77
6,371,072 B1 * 4/2002 Huber ..... 123/195 A
6,397,808 B1 * 6/2002 Tanaka et al. ..... 123/179.25
2002/0023616 A1 * 2/2002 Stone ..... 123/198 R

FOREIGN PATENT DOCUMENTS

GB 2 137 694 A 10/1984
GB 2 234 780 A 2/1991
GB 2 239 899 A 7/1991
JP 5-306627 11/1993
JP 115557 * 4/2002 ..... F02B/67/00

OTHER PUBLICATIONS

British Search Report dated Mar. 1, 2002.

* cited by examiner

*Primary Examiner*—Hieu T. Vo
*Assistant Examiner*—Hai H. Huynh
(74) *Attorney, Agent, or Firm*—Armstrong, Westerman & Hattori, LLP

(57) ABSTRACT

There is provided a multi-cylinder engine having an intake manifold that includes a plurality of induction pipes which are each connected at, one end thereof, to a cylinder head the induction pipes extending away from the cylinder head and being curved to extend along a side of a cylinder block, and thereafter being curved further to approach the cylinder block to finally extend toward the respective one end sides of the induction pipes. In the multi-cylinder engine, a starter motor is disposed in a gap defined between the intake manifold and the cylinder block.

6 Claims, 6 Drawing Sheets

MULTI-CYLINDER ENGINE AND ENGINE AUXILIARY PARTS MOUNTING CONSTRUCTION

BACKGROUND OF THE INVENTION

The present invention relates to a multi-cylinder engine. Particularly, the present invention relates to a multi-cylinder engine having an intake manifold that comprises a plurality of induction pipes, each of which is connected to a cylinder head at one end thereof and at the other end thereof is extended to be away from the cylinder head, is then curved to extend along a side of a cylinder block, is curved further to approach the cylinder block and finally extends toward the side of the one end. In addition, the present invention also relates to a multi-cylinder engine having an electric device. Further, the present invention relates to a construction for mounting engine auxiliary parts on the multi-cylinder engine. More particularly, the present invention relates to a construction for mounting on the multi-cylinder engine an engine auxiliary part disposed in such a manner that upper and lower portions thereof confront a crankcase and an oil pan of the engine, respectively.

Generally, various types of auxiliary parts are mounted on a main body of a multi-cylinder engine. It is a common practice to dispose a starter motor, for imparting rotating force to a crankshaft so as to start the engine, at a position above a transmission or on one side of the engine.

Further, various electric devices are mounted on a main body of a multi-cylinder engine. For example, an alternator for charging a battery which supplies electric power to electric devices installed in an automotive vehicle is disposed on the side of an end of a crank pulley in the engine main body. It is a common practice to dispose an electrode terminal of the. alternator on the side or back of the alternator.

Namely, there is a case where a plurality of engine auxiliary parts, such as an oil pump for a power steering system, an alternator, an engine cooling water pump and a compressor for an air conditioner are mounted on one side of an engine-main body. With such an arrangement of engine auxiliary parts, a space over the one side of the cylinder block and the crankcase is insufficient for the arrangement, and this forces certain auxiliary parts to be disposed even on one side of the oil pan. As this occurs, while auxiliary parts disposed on the crankcase can be bolted directly to the crankcase, auxiliary parts disposed on the oil pan cannot be bolted directly to the oil pan. A bracket is therefore required in which the bracket is connected to the crankcase at one end and extends as far as the side of the oil pan at the other end thereof.

However, since the starter motor includes a certain arrangement of wiring extended from a battery and requires a relatively wide gap for installation, the amount in which the starter motor protrudes from the outer contour of the engine main body tends to be relatively large. This is a first drawback of the prior art.

In addition, conventionally the electrode terminal of alternator is provided at a position which directly faces a body frame or a radiator of an automotive vehicle. Therefore, there may be caused a risk that, in case the automotive vehicle comes into collision, the alternator is brought into contact with the deformed vehicle body to cause a short circuit. This is a second drawback of the prior art.

For example, it is common that a compressor for an air conditioner is fixed with bolts which are inserted in a direction normal to the axis of the cylinders. With this construction in which the bolts are inserted in that direction, the length of the portion of the bracket which extends to the side of the oil pan tends to be increased. To cope with this, the weight of the bracket supported in a cantilever-like fashion has to be increased in order to secure a required rigidity for the bracket. This is a third drawback of the prior art.

SUMMARY OF THE INVENTION

A first aspect of the invention was made to eliminate the first drawback in the prior art. It is a primary object thereof is to provide a multi-cylinder engine which is constructed to promote further the miniaturization thereof.

A second aspect of the invention was made to eliminate the second drawback in the prior art. It is a primary object thereof to provide a multi-cylinder engine which is improved so as to make it difficult for the electrode terminal of the electric device for the engine to be brought into contact with the vehicle body in a collision.

A third aspect of the invention was made with a view to eliminating the third drawback in the prior art. It is a primary object of the invention to provide a construction for a mounting portion for engine auxiliary parts which can secure a required rigidity with the necessity of increasing the length of the bracket being eliminated.

With a view to achieving the object, according to the first aspect of the invention, there is provided a multi-cylinder engine comprising a cylinder block, a cylinder head mounted on the cylinder block, an intake manifold comprising a plurality of the induction pipes, each of the induction pipes being connected to the cylinder head at one end thereof and, at the other end thereof, extending to be away from the cylinder head, then curved to extend along a side of a cylinder block, and curved further to approach the cylinder block, and finally extending toward the side of said one end, an auxiliary part disposed in a gap defined between said intake manifold and said cylinder block.

In particular, in the above-mentioned structure it is advantageous that the auxiliary part comprises a starter motor that includes magnet switches sunk in said gap and arranged in parallel with each other.

Furthermore, in the above-mentioned structure it is advantageous that the multi-cylinder engine further comprises an electric device for the engine, the electric device located adjacent to the intake manifold, wherein an electrode terminal of the electric device is disposed at a location which confronts an end face of said intake manifold in a direction in which the cylinders are arranged.

In addition, in the above-mentioned structure it is advantageous when said electric device for said engine comprises an alternator.

According to the construction, since the dead gap can be used effectively, useless gap can be reduced so as to promote the miniaturization of the entirety of engine.

With a view to attaining the object, according to the second aspect of the invention, there is provided a multi-cylinder engine comprising an electric device (for example, an alternator 4 in an embodiment) for the engine, a component (for example, an intake manifold 15 in the embodiment) fixed at a position adjacent to the electric device; wherein an electrode terminal of the electric device is disposed at a location which confronts an end face of the component in a direction in which cylinders of the engine are arranged.

In particular, in the above-mentioned structure it is advantageous that the electric device for said engine comprises an alternator and the component is an intake manifold.

According to the construction, even if the vehicle body is deformed in a collision, since it is protected by the intake manifold, or the like, the contact of the electrode terminal with the deformed vehicle body is made difficult.

With a view to achieving the object, according to the third aspect of the invention, there is provided a construction for mounting an engine auxiliary part (a compressor 6 for an air conditioner as described in an embodiment) on an engine, the mounting construction comprising bolts threadedly fastened from a side of an engine main body to fix the engine auxiliary parts to the engine main body at the upper and lower positions of the engine auxiliary part while the upper and lower portions of said engine auxiliary part confronts a crankcase and an oil pan, respectively, wherein axes of said bolts are inclined relative to an axial direction of a cylinder of said engine.

According to this construction, the side of the engine auxiliary part, which faces the oil pan, can be made closer to the crankcase.

Additionally, according to the third aspect of the invention, there is provided the engine auxiliary part being disposed on one side of the engine main body and apart from the engine main body, and the engine auxiliary part being driven by an endless belt for commonly driving the other auxiliary parts.

According to this construction, in trying to drive the plurality of engine auxiliary parts with a common endless belt, in order to secure a certain angle of belt wrap relative to pulleys, the auxiliary parts have to be disposed close to, and apart from, the engine main body laterally in an alternately zigzagged fashion, respectively, but when the axes of the fixing bolts of the auxiliary parts disposed apart from the engine main body are inclined the side of the auxiliary parts which faces the oil pan can be made closer to the crankcase.

Additionally, according to the third aspect of the invention, there is provided a hook-shaped temporary locking member disposed at a location where at least the upper portion of said engine auxiliary part is fixed to said engine main body.

According to this construction, the necessity of holding the auxiliary parts while the bolts are passed through can be obviated.

DETAILED DESCRIPTION OF THE INVENTION (The first embodiment according to the invention will be described in detail below with reference to FIGS. 1 to 4).

Figure 1:
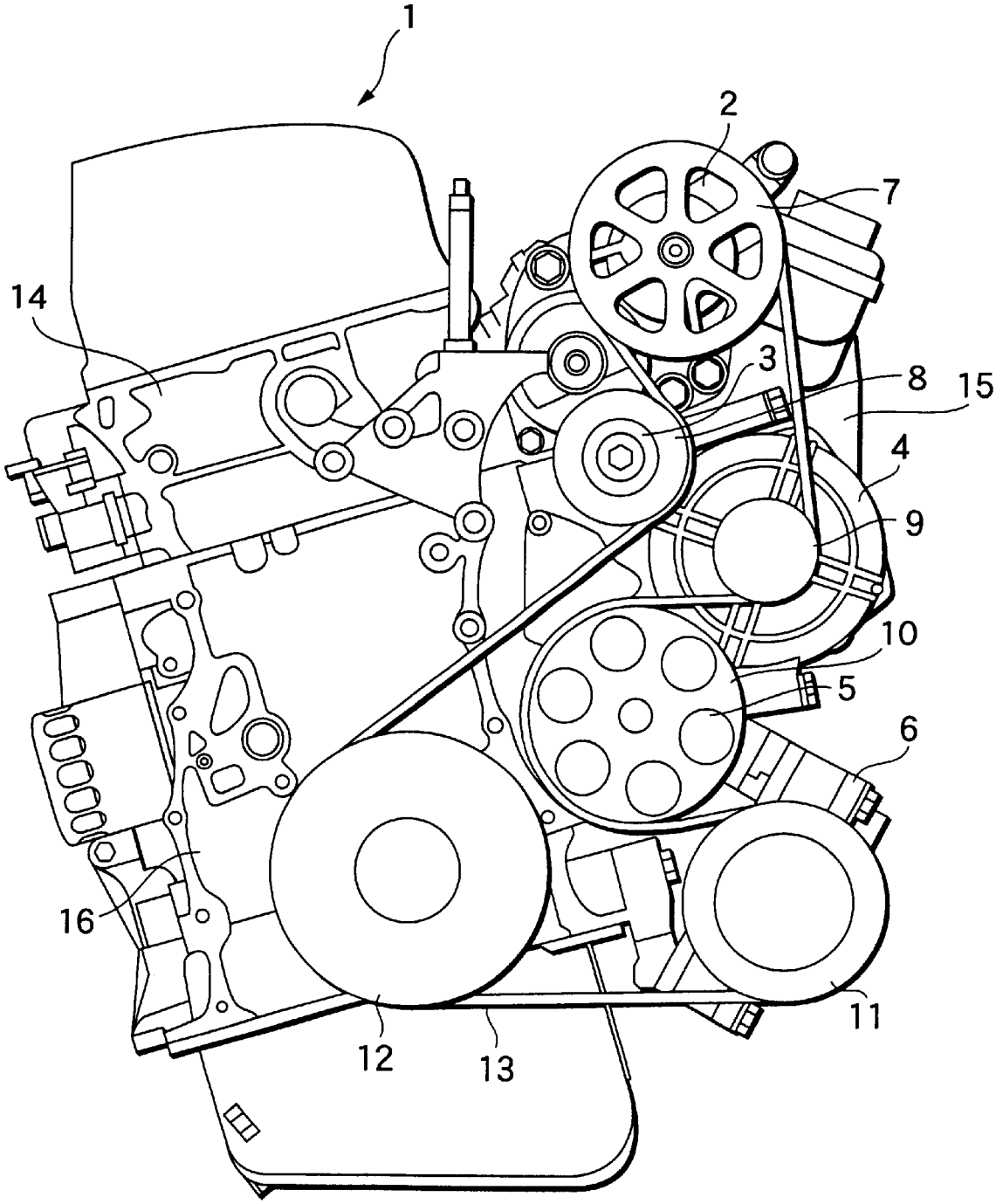
FIG. 1 is a front view of a crank pulley side of an in-line multi-cylinder engine according to the invention.

FIG. 1 is a view of an in-line multi-cylinder engine to which the invention is applied as seen from a crank pulley side thereof. Disposed on an engine main body 1 of the engine by the side of an end of a crank pulley 12 are an oil pump 2 for a power steering system, a tensioner pulley 3, an alternator 4, an engine cooling water pump 5 and a compressor 6 for an air conditioner, in that order from above. These auxiliary parts are driven altogether by power transmitted from a crankshaft via a single (common) endless belt 13. The single endless belt 13 is looped around pulleys 7 to 11 provided on the respective auxiliary parts and a crank pulley 12 in a so-called serpentine fashion. In order to ensure that a certain angle of belt wrap is secured between the respective pulleys 7 to 11 and the belt 13, the pulleys 7 to 11 are positioned in a laterally alternating zigzagged fashion sequentially from above. This laterally alternating zigzagged fashion of the pulleys 7 to 11 can be achieved by positioning the oil pump 2, the tensioner pulley 3, the alternator 4, the engine cooling water pump 5 and the air conditioner compressor 6 as follows. The oil pump 2 for the power steering system, the alternator 4 and the air conditioner compressor 6 are disposed so as to be apart from the engine main body 1 to the right as viewed in FIG. 1. On the other hand, the tensioner pulley 3 and the engine cooling water pump 5 are disposed so as to get closer to the engine main body 1.

Thus, the plurality of auxiliary parts 2 to 6 are disposed on one side of the engine main body 1 in a compact fashion, so that it is ensured that the plurality of auxiliary parts 2 to 6 can be driven with the single endless belt 13.

Figure 2:
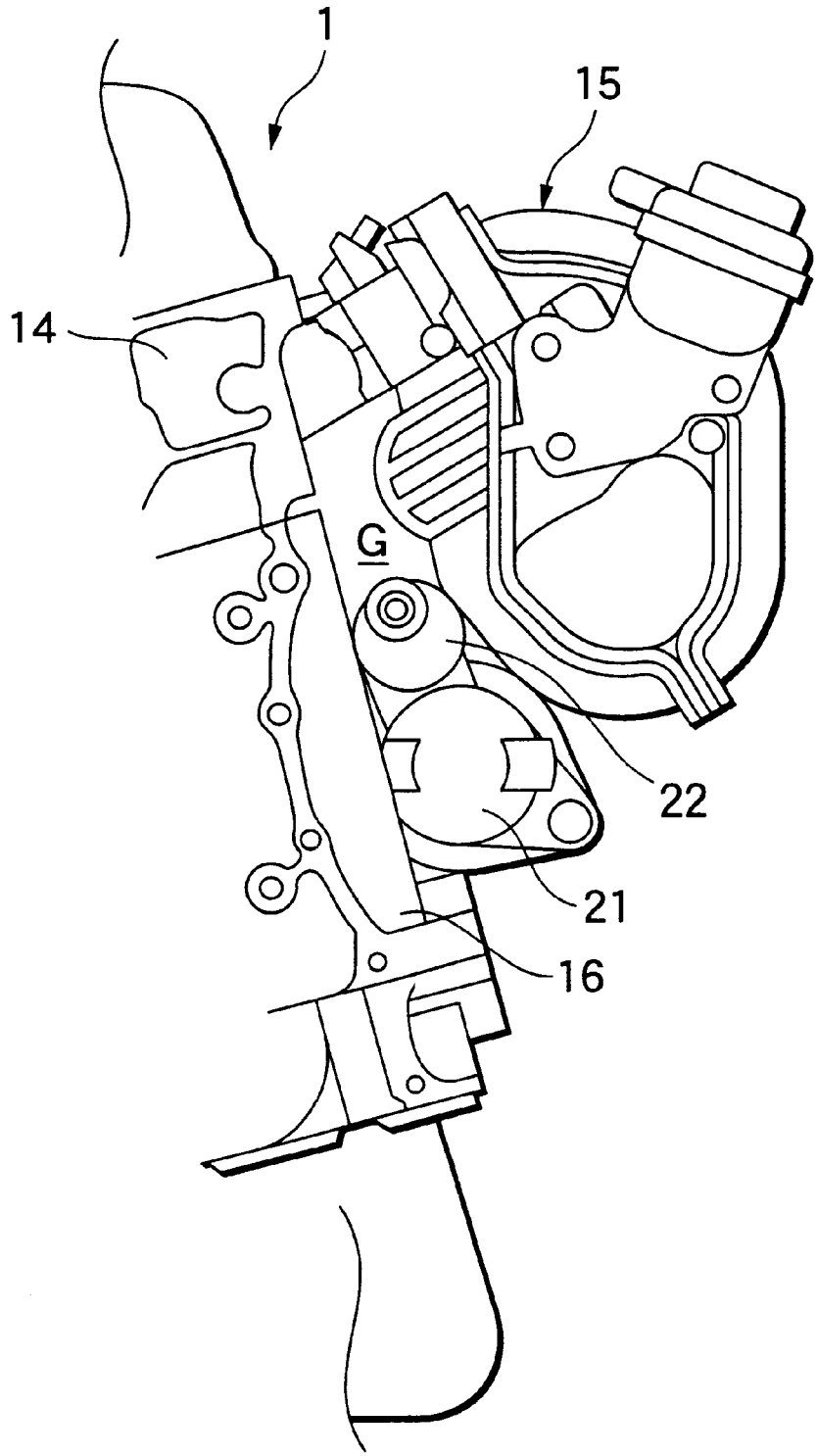
FIG. 2 is a front view of the engine shown in FIG. 1 showing only a main part thereof.
Figure 3:
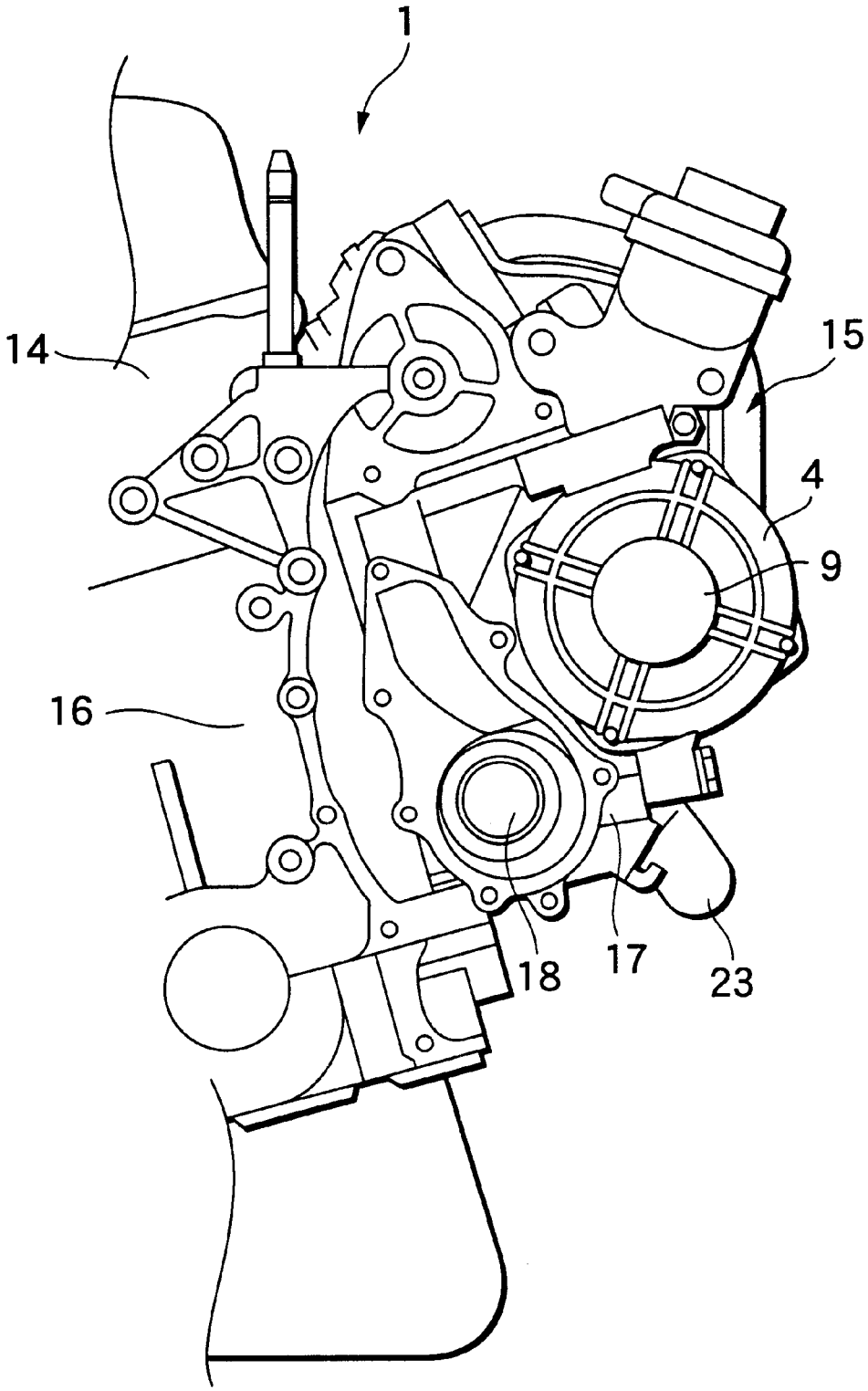
FIG. 3 is a front view of the engine shown in FIG. 1 showing only a main part thereof.
Figure 4:
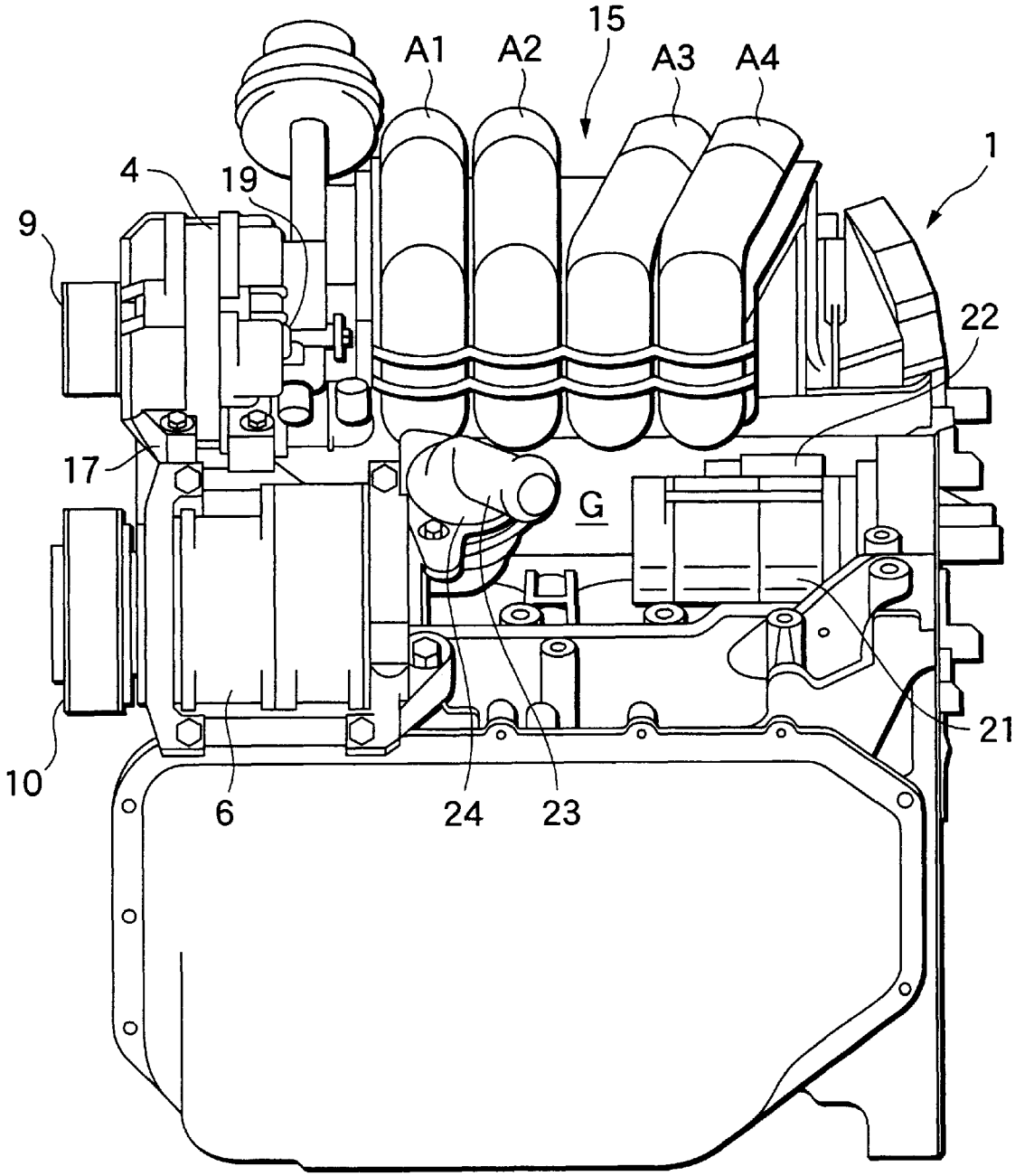
FIG. 4 is a view of the engine shown in FIG. 1 as viewed obliquely upwardly from below.

As shown in FIGS. 2 and 4, an intake manifold 15 is disposed at a cylinder head 14 on the side where the auxiliary parts are disposed. Note that FIG. 2 shows the relevant portion of the engine from which the auxiliary parts 2 to 6 are removed. Note that FIG. 3 shows the relevant portion of the engine from which all of the auxiliary parts except the alternator 4 are removed. The intake manifold 15 comprises four induction pipes A1, A2, A3, A4 which are independent from each other for each cylinder and are arranged in parallel in a direction in which the cylinders are arranged. The respective induction pipes A1, A2, A3, A4 are each connected at one end to the cylinder head 14. The other ends of the respective induction pipes extend to be away from the cylinder head 14, are then curved to extend downwardly along a side of a cylinder block 16, are curved further to approach the cylinder block 16, and finally extend toward the one end thereof where they are connected to the cylinder head 14, i.e., upwardly. In other words, each of the induction pipes are wound into a snail shape.

An intake air collecting chamber connected to a throttle body and rotary valves for varying the lengths of the induction pipes in a stepped fashion are provided at a central portion where the induction pipes A1, A2, A3, A4 are wound. However, the detailed description thereof will be omitted here.

In this embodiment, a gap G is produced between the intake manifold 15 and the cylinder block 16. A starter motor 21 is disposed in the gap G.

The starter motor 21 has magnet switches 22 for switching electric current from a battery (not shown) to the starter motor 21. The magnet switches 22 are arranged in parallel on the starter motor 21. The magnet switches 22 are disposed in such a manner as to sink completely in the gap G defined between the intake manifold 15 and the cylinder block 16, thus aiming at improving the space efficiency of the entirety of the engine.

In addition, a thermo case 24 made integral with a hose opening 23 and incorporating therein a thermostat valve is mounted on a portion formed integrally with the alternator mounting bracket 17 and is disposed between the air conditioner compressor 6 and the starter motor 21 in the direction in which the cylinders are arranged and below the intake manifold 15.

However, the alternator 4, located at an intermediate position among the aforesaid plurality of auxiliary parts 2 to 6, is, as described above, disposed apart from the engine main body 1 to the right as viewed in FIG. 1. In order to fix the alternator 4 at such a position, the alternator 4 is bolted to the side of the cylinder block 4 via the alternator mounting bracket 17 at upper and lower positions thereof. A cooling water passage 18 is formed in the alternator mounting bracket 17 in such a manner as to connect with the cooling water pump. Thus, the bracket 17 is used not only as the mass increasing bracket but also as a multi-functional member.

The alternator 4 has an electrode terminal 19 that is connected to a battery (not shown). The electrode terminal 19 is disposed on an end face of the alternator that is located on a side opposite to the pulley side. The electrode terminal 19 confronts an end face of the intake manifold 15 in a direction in which the cylinders are arranged.

In a case where the engine main body 1 is installed transversely relative to the vehicle body, the vehicle frame deformed in accidental collision comes into abutment with the intake manifold 15. At this time, the intake manifold acts as a protection barrier for eliminating a risk of the electrode terminal 19 being brought into contact with the vehicle frame.

Hereinafter, a second embodiment according to the present invention will be described in detail with respect to FIGS. 5 to 6.

Figure 5:
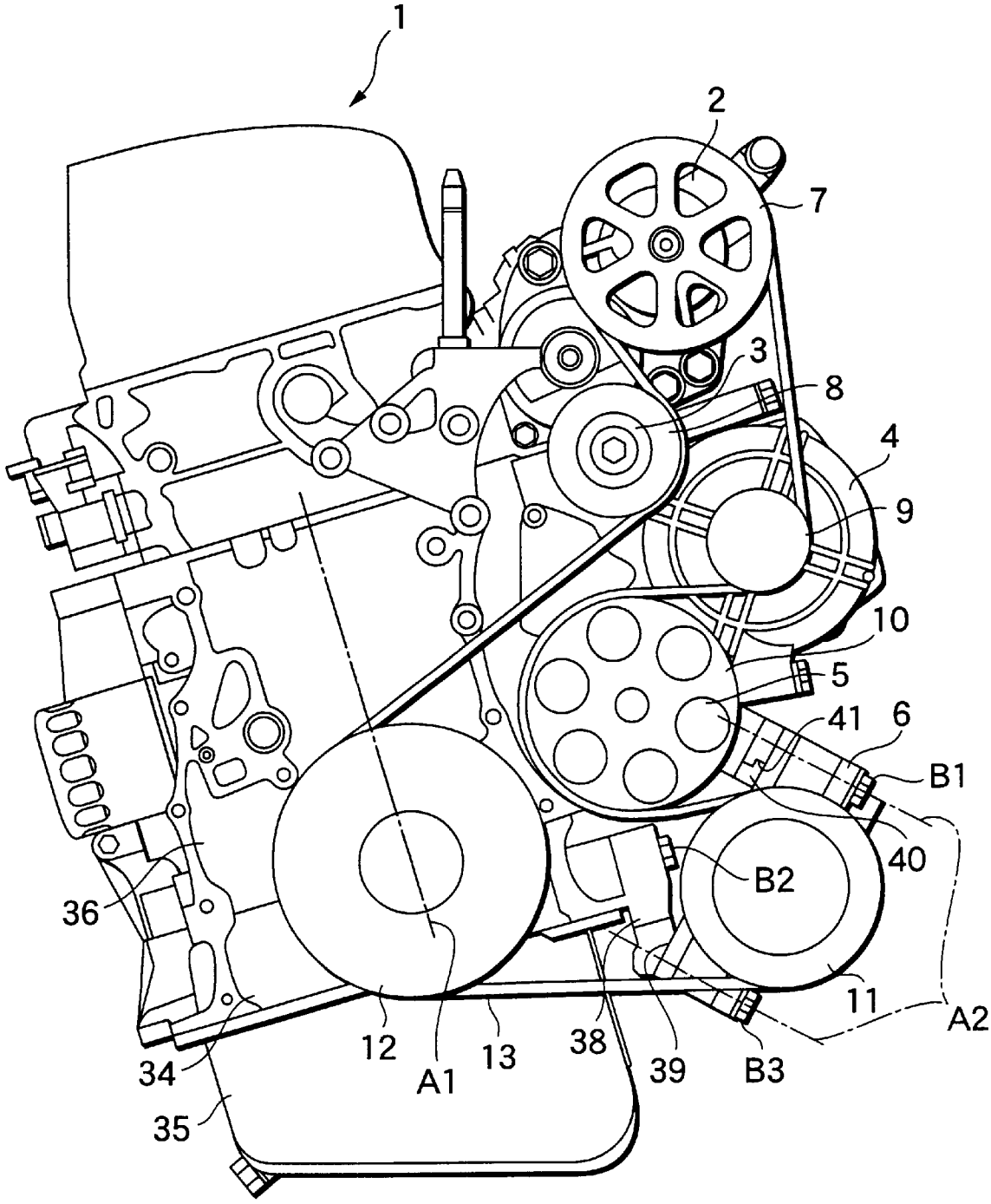
FIG. 5 is a front view of a crank pulley side of a modified in-line multi-cylinder engine according to the invention.
Figure 6:
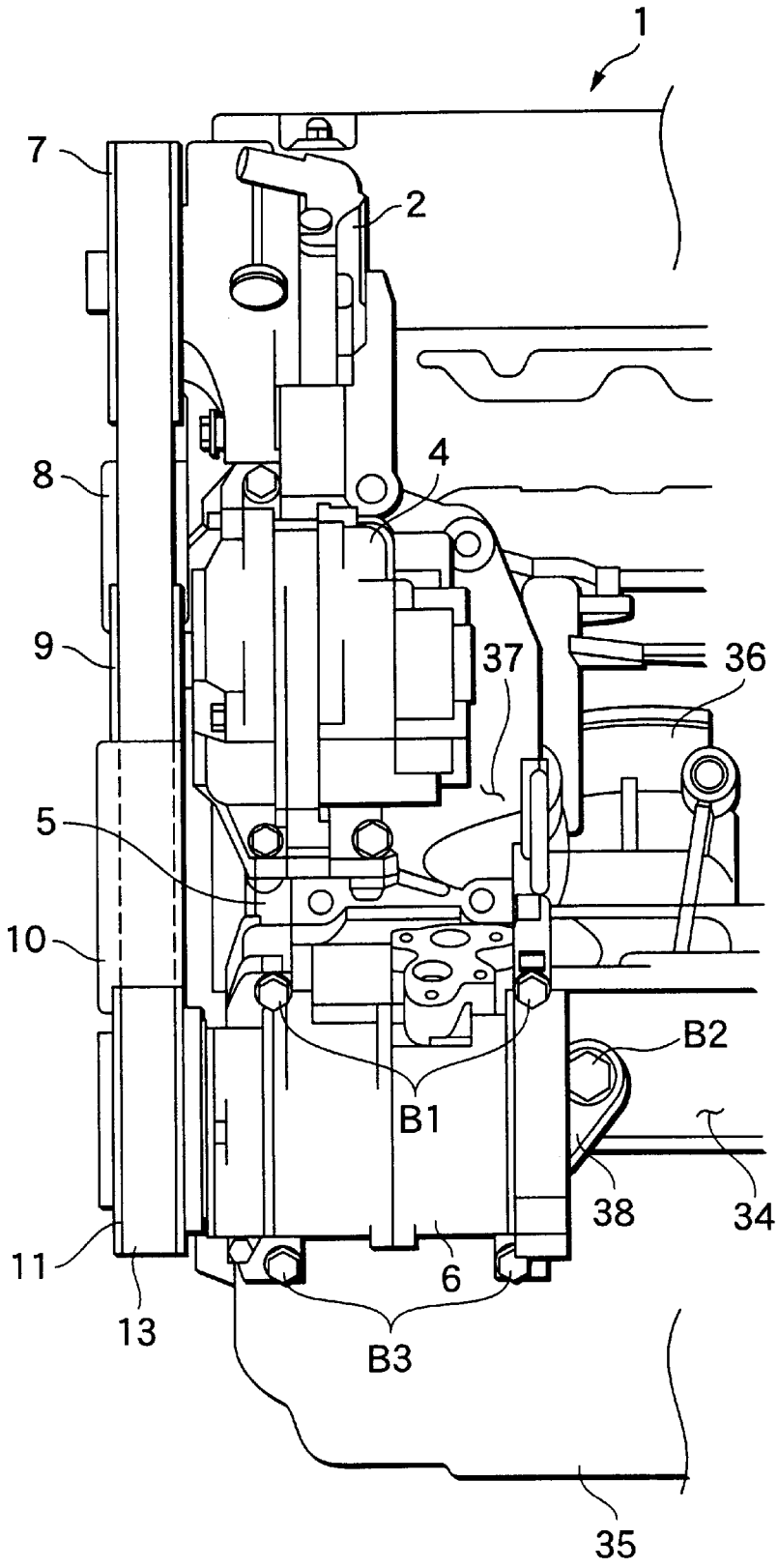
FIG. 6 is a right side view of a main part of the engine shown in FIG. 5.

FIGS. 5 and 6 show an in-line multi-cylinder engine constructed based on the invention. FIG. 5 is a view of the engine seen from a crank pulley side. FIG. 6 is a view of only a front portion of the engine seen from the fight-hand side of the engine. Explanation of a portion, which has the same numerals, as the portion described above, will be omitted here.

The air conditioner compressor 6 is located at the lowest position among the plurality of auxiliary parts 2 to 6. The air conditioner compressor 6 confronts a side of a lower crankcase 34 and a side of an oil pan 35 at upper and lower portions thereof, respectively. The upper portion of the compressor 6 is fixed with bolts B1 to an integrated auxiliary parts bracket 37 incorporating therein a cooling water passage extending to the water pump 5 and fixed in turn to a side of a cylinder block 16. On the other hand, the lower portion of the compressor 6 is fixed with bolts B3 to a free end of a bracket 38 which is fixed to the side of the lower crankcase 34 at one end thereof with bolts B2. Note that the integrated auxiliary parts bracket 37 also functions as a bracket for mounting the oil pump 2 for the power steering system, the alternator 4, the engine cooling water pump 5 and a thermostat case to the engine main body 1.

Here, a surface 39 of a mounting leg of the air conditioner compressor 6, which confronts the engine main body 1, is inclined at an acute angle relative to the axis A1 of a cylinder. The bolts B1, B3 for fixing the air conditioner compressor 6 to the engine main body 1 are inserted upwardly such that axes A2 thereof are inclined relative to the cylinder axis A1. Accordingly, the lower fixing portion of the air conditioner compressor 6 is allowed to get closer to the lower crankcase 34 by imparting to the axes A2 of the mounting bolts B1, B3 such an inclination angle that ends of the mounting bolts which face the center of the cylinder are directed upwardly. Therefore, the lengthwise dimension of the bracket 37 bolted to the lower crankcase 34 at one end thereof can be reduced further.

Hook-shaped portions 40 are formed at air conditioner compressor bolt pass-through portions of the integrated auxiliary parts bracket 37. In addition, recessed portions 41 are formed in upper mounting legs of the air conditioner compressor 6 in such a manner as to be caught on the hook-shaped portions 40. The air conditioner compressor 6 is designed to be temporarily locked on the integrated auxiliary parts bracket 37, i.e., the engine main body 1 through engagement of the hook-shaped portions 40 with the recessed portions 41. Accordingly, it is possible to obviate the necessity of manual support of the air conditioner compressor in tightening the air conditioner compressor fixing bolts B1, B3.

Thus, according to the invention, since the dead space produced between the intake manifold and the cylinder block can be used effectively, the invention can be largely advantageous in promoting further the miniaturization of the entirety of engine by reducing useless space.

Thus, according to the the invention, since the contact of the electric device such as the alternator with the vehicle body frame deformed in collision is prevented, the invention is largely advantageous in reducing the possibility of occurrence of a risk that a secondary disaster such as a short circuit may be caused in collision.

Thus, according to the third aspect of the invention, since the length of the overhang portion of the bracket for fixing the auxiliary parts, which confronts the oil pan, can be reduced, the construction can be greatly advantageous in imparting the required rigidity to the bracket without increasing the weight thereof.

In addition, according to the invention, the auxiliary parts have to be disposed close to, and apart from, the engine main body in an alternating zigzagged fashion with a view to securing the required angle of belt wrap so that the plurality of auxiliary parts can be driven by the common endless belt. Since the side of the auxiliary parts disposed apart from the engine main body, which confronts the oil pan, is allowed to get closer to the crankcase by inclining the bolt axes of the auxiliary parts, the construction can be advantageous in miniaturizing the cantilever-like auxiliary parts coupling bracket.

Furthermore, according to the invention, the necessity of manual support of the auxiliary parts in passing through the bolts can be obviated by temporarily locking at least the upper fixing portions of the auxiliary parts to the engine main body through the use of the hook-like portions. Accordingly, the construction can be advantageous in improving the efficiency of bolt tightening work.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A multi-cylinder engine comprising:

a cylinder block;

a cylinder head mounted on said cylinder block;

an intake manifold comprising a plurality of induction pipes, each of said induction pipes being connected at one end thereof to said cylinder head, said induction pipes extending substantially coextensively away from said cylinder head and being curved to extend along aisle of said cylinder block and being further curved inwardly toward said cylinder block, and finally extending generally parallel to said side of the cylinder block back toward one end of the respective pipe ends to define a substantially closed annular induction pipe arrangement laterally spaced from said side of said cylinder block; and at least one auxiliary engine part being mounted on the cylinder block and disposed in a gap disposed between said induction pipe arrangement and said cylinder block.

2. The multi-cylinder engine as set forth in claim 1, further comprising:

an electric device for said engine, said electric device being located adjacent to said intake manifold, wherein an electrode terminal of said electric device is disposed at a location which confronts an end face of said intake manifold in a direction in which said cylinders are arranged.

3. The multi-cylinder engine as set forth in claim 2, wherein said electric device for said engine comprises an alternator.

4. The multi-cylinder engine comprising:

a cylinder block;

a cylinder head mounted on said cylinder block;

an intake manifold comprising a plurality of induction pipes, each of said induction pipes being connected at one end thereof to said cylinder head, said induction pipes extending away from said cylinder head and being curved to extend along a side of said cylinder block and being further curved inwardly to approach said cylinder block, and finally extending back toward a side of an associated one end; and at least one auxiliary engine part being mounted on the cylinder block and disposed in a gap defined between said induction pipes of said intake manifold and said cylinder block, wherein said at least one auxiliary engine comprises a starter motor including a plurality of magnet switches received in said gap and arranged in parallel with each other.

5. A construction for mounting engine auxiliary parts on an engine, said mounting construction comprising:

bolts threadedly fastened from a side of an engine main body to fix the engine auxiliary parts to said engine main body at the upper and lower positions of said engine auxiliary parts while the upper and lower portions of said engine auxiliary parts confront a crankcase and an oil pan, respectively;

wherein axes of said bolts are inclined relative to an axial direction of a cylinder of said engine, and a hook-shaped temporary locking member is provided at a location where at least the upper portion of said engine auxiliary parts is fixed to said engine main body.

6. The mounting construction for a multi-cylinder engine comprising:

an electric device for said engine;

a component fixed at a position adjacent to said electric device;

wherein an electrode terminal of said electric device is disposed at a location which confronts an end face of said component in a direction in which said cylinders are arranged, wherein said engine auxiliary parts are disposed on one side of the engine main body and apart from said engine main body, and said engine auxiliary parts are driven by an endless belt for commonly driving he other auxiliary parts, and wherein a hook-shaped temporary locking member is provided at a location where at least the upper portion of said engine auxiliary parts is fixed to said engine main body.

* * * * *